US005484697A

United States Patent [19]

Mignot et al.

[11] Patent Number: 5,484,697

[45] Date of Patent: Jan. 16, 1996

[54] METHOD FOR OBTAINING MONODISPERSE TABULAR GRAINS

[75] Inventors: Andre G. E. Mignot, Brie Comte Robert; Pierre H. Jezequel, Saint-Desert, both of France

[73] Assignee: Eastman Kodak Company, Rochester, N.Y.

[21] Appl. No.: 142,282

[22] PCT Filed: May 11, 1992

[86] PCT No.: PCT/FR92/00417

§ 371 Date: Nov. 12, 1993

§ 102(e) Date: Nov. 12, 1993

[87] PCT Pub. No.: WO92/21061

PCT Pub. Date: Nov. 26, 1992

[30] Foreign Application Priority Data

May 14, 1991 [FR] France ..... 91 05985

[51] Int. Cl.[6] ..... G03C 1/015; G03C 1/035

[52] U.S. Cl. ..... 430/569; 430/567

[58] Field of Search ..... 430/567, 569

[56] References Cited

U.S. PATENT DOCUMENTS

| | | | |
|---|---|---|---|
| 3,801,326 | 4/1974 | Claes | 430/569 |
| 3,897,935 | 8/1975 | Forster et al. | 366/339 |
| 4,150,994 | 4/1979 | Maternaghan | 430/569 |
| 4,171,224 | 10/1979 | Verhille et al. | 430/569 |
| 4,386,156 | 5/1983 | Mignot | 430/567 |
| 4,585,733 | 4/1986 | Ezaki et al. | 430/569 |
| 4,722,886 | 2/1988 | Nottorf | 430/569 |
| 4,775,617 | 10/1988 | Goda | 430/567 |
| 5,035,991 | 7/1991 | Ichikawa et al. | 430/569 |
| 5,104,786 | 4/1992 | Chronis et al. | 430/569 |

FOREIGN PATENT DOCUMENTS

| | | |
|---|---|---|
| 0019847 | 12/1980 | European Pat. Off. . |
| 2172751 | 10/1973 | France . |
| 2534036 | 4/1984 | France . |
| 3707135 | 9/1987 | Germany . |

*Primary Examiner*—Richard L. Schilling
*Assistant Examiner*—Mark F. Huff
*Attorney, Agent, or Firm*—Paul A. Leipold

[57] ABSTRACT

The present invention relates to a method for preparing a photographic tabular silver halide grains emulsion. The method is characterized in that the twinned silver halide seeds are precipitated, either in an external static nucleator working in laminar flow regime with a Reynolds number less than 2100, or in a kettle with a very low stirring rate with respect to the one generally used, and in that the concentration of the $Ag^+$ ion solution is ranging from 0.04 to 0.3M.

Obtained are tabular silver halide grains, the diameter distribution of which is less than 15%.

7 Claims, 4 Drawing Sheets

METHOD FOR OBTAINING MONODISPERSE TABULAR GRAINS

FIELD OF THE INVENTION

The present invention relates to a method for preparing a photographic emulsion containing gelatin and tabular silver halide grains exhibiting a narrow size distribution.

DESCRIPTION OF THE PRIOR ART

The tabular silver halide grains, their preparation methods and their use have been extensively studied these last years, and they are used in commercial products. By "tabular grain" is meant a grain defined by two parallel or substantially parallel crystalline faces, each exhibiting a notably greater surface than any other crystal face forming the grain. The aspect ratio, i.e., the diameter/thickness ratio is more than at least 2:1, and preferably, more than at least 5:1. The diameter is defined as being the diameter of an equivalent circle obtained from the grain projected area, as viewed in a photomicrograph or in an electron micrograph of an emulsion sample.

The advantages of these grains are well known: they provide a better image sharpness, a higher covering power, a better relationship between sensitivity and granularity, a better separation between the blue and the minus blue, and allow to use lower silver coverages and thinner emulsion layers.

Numerous methods for preparing the tabular silver halide emulsions have been disclosed. For example, U.S. Pat. No. 4,434,226 discloses tabular halide grains having a thickness less than 0.5 μm, a diameter of at least 0.6 μm, an average aspect ratio more than 8:1 and representing at least 50% of the total grain projected area. These grains are prepared by a double jet method at a pBr ranging between 0.6 and 1.6.

By this method, tabular silver halide grains exhibiting a wide size distribution are obtained.

However, it would be highly desirable to provide a method for preparing monodisperse tabular silver halide grains, i.e., exhibiting a narrow size distribution. The advantages due to the narrow size distributions are well known, the number of photographically useful grains is increased, the sensitization can be more easily controlled since the grains exhibit similar sizes, the contrast and the granularity of the resulting photographic element are improved.

In the present description, the dispersity is, unless otherwise stated, represented by the coefficient of variation of the diameter (COV), which is the ratio between the diameter standard deviation of the grains and the mean diameter of these grains. The cited values refer to measures performed on electron micrographs of the grains.

French Patent No. 2,534,036 discloses a method for preparing hexagonal and triangular monodisperse flat grains having a thickness less than 0.3 μm, an aspect ratio of at least 5:1 and representing at least 97% of the total grain projected area. The coefficient of variation expressed as % of grains versus grain diameter varies between 15 and 28.4% in the examples. This method consists in precipitating fine grains having a diameter less than 0.15 μm and letting them undergo a physical ripening at a pAg ranging from 8.4 to 11, without any complexing agent.

U.S. Pat. No. 4,775,617 discloses a method for preparing monodisperse flat grains having a thickness ranging between 0.5 and 6 μm, an aspect ratio ranging between 5:1 and 30:1 and a coefficient of variation (COV) of at least 20%, the tabular grains forming at least 50% of the total grain projected area. The method consists in growing the grains by controlling the concentration flowrate of the halide and silver ion solutions at 50–60% of the crystal critical growth rate.

U.S. Pat. No. 4,722,886 discloses a method for preparing tabular grains having a thickness ranging between 0.05 and 0.5 μm, an average grain volume ranging between 0.05 and 1 $\mu m^3$ and an aspect ratio more than 2:1. The emulsion predominantly contains tabular grains. The method includes several steps, the precipitation being performed in presence of ammonia, which is then neutralized before the ripening and the growth. The dispersity is calculated in volume, which is not really significative for flat grains, in the absence of data on the grain thickness variations.

German Patent No. 3,707,135 discloses a method for preparing monodisperse tabular grains having a grain size ranging between 0.2 and 3 μm, an aspect ratio ranging between 2.5:1 and 20:1. The projected area of hexagonal tabular grains is at least 70% of the total projected area. The coefficient of variation (COV) does not exceed 20% and preferably, is less than 15%. In this method, the nucleation temperature is reduced in order to obtain only hexagonal grains, without triangles.

According to these prior art patents, it can be seen that it is very difficult to obtain tabular grains having a coefficient of variation less than 15% and which represent at the same time up to 99% of the projected area. Either a significant proportion of tabular grains can be obtained (up to 99% of the projected area) but the variation coefficient is high, or a low variation coefficient can be obtained, but there are few tabular grains. On the other hand, the methods for preparing silver halide emulsions which can be used on an industrial scale must exhibit specific characteristics, particularly for the speed and the reproducibility, which allow to reduce the cost thereof. This is the reason why there is a constant need for more performing methods in order to manufacture monodisperse tabular silver halide emulsions.

SUMMARY OF THE INVENTION

According to the present invention, these objects can be achieved with a method consisting in (a) precipitating twinned silver halide seeds from silver nitrate and halide solutions, in a precipitation medium, exhibiting a laminar flow regime, the concentration of the silver nitrate solution ranging between 0.04 and 0.3M, and the seeds being received in a receiving medium;

(b) ripening the seeds by stopping the addition of reagents, under strong stirring, during 1 to 90 mn, and preferably during 20 to 30 mn, at a VAg more than 0 mV and preferably more than 20 mV;

(c) growing the grains by a double jet technique under strong stirring, at a VAg more than +10 mV and preferably more than 20 mV.

DESCRIPTION OF THE PREFERRED EMBODIMENTS

The main characteristics of the present method are the flow regime and the low concentration of the silver salt solution used to prepare the silver halide seeds during the first step.

In the process according to the invention, a continuous external nucleator is used, wherein the $Ag^+$ ion and halide solutions arriving separately in a continuous flow, are mixed in a laminar, non turbulent way, the very low stirring being defined by a Reynolds number less than 2100. The seeds formed are then directed towards the main kettle where the second step, or ripening, and then the third step, or growth, will occur. Devices allowing to carry out this first embodiment of the method according to the invention will be described below.

The seeds are then allowed to wait under the ripening conditions while vigorously stirring, before carrying out the growth. By way of example, the stirring rate of the ripening (b) and growth (c) steps is ranging between 4000 and 5000 rpm for a 20 l kettle.

The present invention relates to a tabular silver halide emulsion prepared by the above disclosed method, this emulsion being characterized in that it contains at least 60% of tabular grains with respect to the total grain number and in that the diameter variation coefficient is less than 15% and preferably, less than 10%.

The following description illustrates the external static nucleators allowing to carry out the first embodiment of the invention. FIGS. 1 to 4 are schematic drawings of useful static nucleators.

Figure 1:
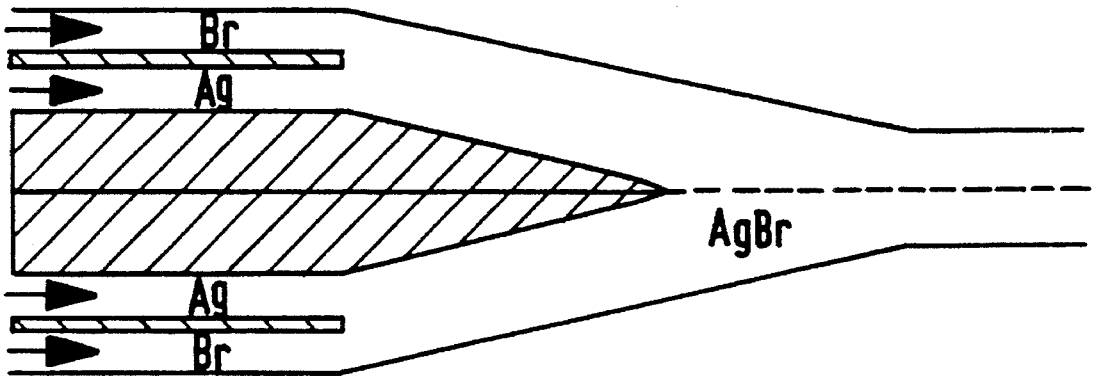
FIG. 1 represents a nucleator where the solutions are fed in parallel in the same direction.

The nucleator of FIG. 1 is a reactor exhibiting a cylindrical symmetry wherein the halide and silver nitrate solutions are fed in parallel, so that the precipitation reaction mainly occurs at the interface of these fluids. The conical portion located in front of the nucleator allows the fluid to be accelerated. The position of the central cone is adjustable to allow to alter the ejection rate of the fluids out of the nucleator. A tube exhibiting a variable length, not shown here, extends the nucleator.

Figure 2:
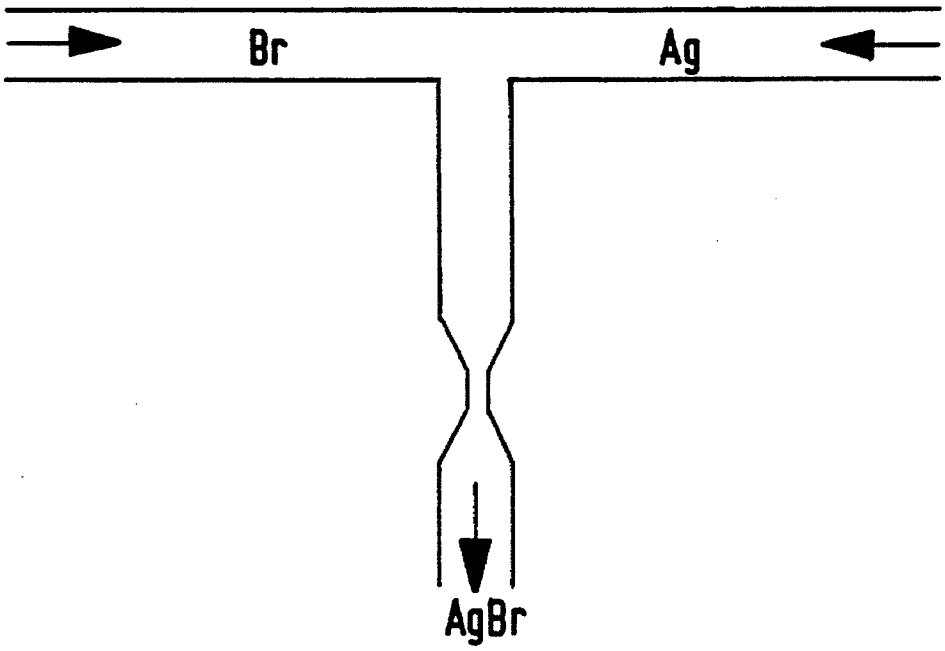
FIG. 2 represents a T-shaped nucleator where the solutions are fed in parallel in opposite directions.

The device of FIG. 2 is a "T"-shaped reactor, wherein the fluids are fed in parallel in opposed directions and are ejected perpendicularly to this direction. During the ejection, the fluids can meet a portion having a lower diameter, allowing to adjust the ejection rate and possibly, to be subjected to a low stirring.

Figure 3:
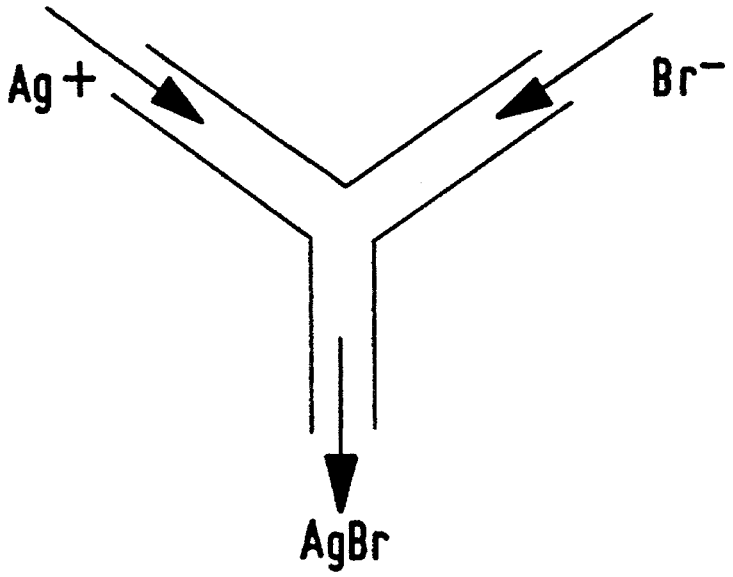
FIG. 3 represents a Y-shaped nucleator where the solutions are fed with an angle of 45°.

The "Y"-shaped device of FIG. 3 is similar, in its principle, to the device of FIG. 2 but differs in that the fluids are no more fed in parallel but with an angle of 45°.

Figure 4:
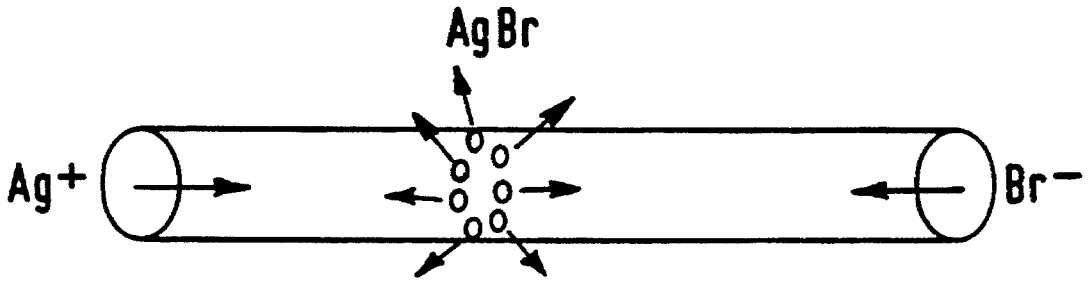
FIG. 4 represents a nucleator where the solutions are fed in opposite directions as in FIG. 2 and the ejection is provided through holes arranged as a crown.

The device of FIG. 4 is similar to the device of FIG. 2 as regards the introduction of the reagents, but the ejection is provided by one or several rows of holes arranged as a crown, all the holes having the same diameter and forming at least an angle of 15°.

In addition to their shape, the above disclosed nucleators contribute to determine an average residence time of the seeds, characterized by the mean duration spent by a fluid element of the Ag nitrate solution between the time it is contacted by the halide salt solution and the time it is ejected as silver halide seeds. This average residence time depends also on the introduction flowrates of the fluids into the nucleator.

The total duration of step (a) including the formation of the twinned seeds varies between 10 and 300 seconds.

In any case, the solution containing the seeds is directed towards a gelatin solution, referenced below as a "receiving medium".

Without being bonded by a particular theory, it is thought that the claimed nucleation conditions, i.e., the flow regime and the low concentration of silver salt, allow to obtain homodisperse twinned seeds, among other seeds. It was observed that these homodisperse twinned seeds were obtained whatever the nucleation VAg may be, which is on principle only a mean VAg calculated according to the concentration of the halide and silver salt solutions, and to the flowrate of these solutions. These seeds are all the more homodisperse since the physicochemical conditions of the receiving medium of these seeds, reduce the possibility of a rapid ripening of the grains. These conditions are generally met if the VAg of the receiving medium is high enough, i.e., more than −10 mV, for example 30 mV, in which case the nucleation duration does not significantly affect the dispersity of the twinned seeds. In the case where the physicochemical conditions of the receiving medium promote the ripening, the extension of the nucleation duration will contribute to increase the dispersity of the twinned seeds.

The second step, or ripening, allows to remove all the non twinned seeds for the benefit of the twinned seeds. The ripening conditions must be carefully controlled in order not to destroy the initial homodispersity of the seeds, and particularly the VAg and the ripening duration. A lower VAg provides a more effective ripening, however, the duration must be reduced. If the ripening duration is too long, the tabular grains begin to destroy themselves and the homodispersity is lost. The optimum ripening conditions providing the best % tabular grains/COV ratio can be determined, these conditions can vary according to the nucleation conditions. In practice, the ripening VAg is more than 0 mV, and preferably more than 20 mV. The ripening duration can vary for example between 20 and 30 minutes for a ripening VAg of more than 20 mV.

In the case of the laminar external nucleator, the tube length between the location where the solutions flows come into contact and where the seeds are forming and the location where the seeds arrive into the reactor, must be taken into account. Indeed, the tube must be considered as a reactor wherein the ripening occurs all the more rapidly since the seeds are small. The length of the tube coupled to the introduction flowrates of the reagents determines an average residence time in the nucleator that can be varied from 0.5 ms to 20 ms, according to the nucleators used.

It is also possible to precede the ripening step by a phase during which the VAg is decreased rapidly to values less than −15 mV by adding a concentrated silver bromide solution, followed at least one minute later by a gelatin dump coupled to a temperature increase, allowing to increase the VAg to the value used for the ripening. This step allows to possibly retwin a few seeds which would not have been twinned during nucleation.

After the ripening, the double jet growth is carried out with silver salt and halide solutions having concentrations ranging from 0.5M to 4M, while vigorously stirring, at a temperature ranging from 35° to 70° C., and with a flowrate profile which must be controlled in order to avoid renucleation, but must be close to the critical growth rate.

The growth VAg must be more than +10 mV, and preferably more than 20 mV, in order to preserve the initial homodispersity of the twinned seeds.

Figure 5:
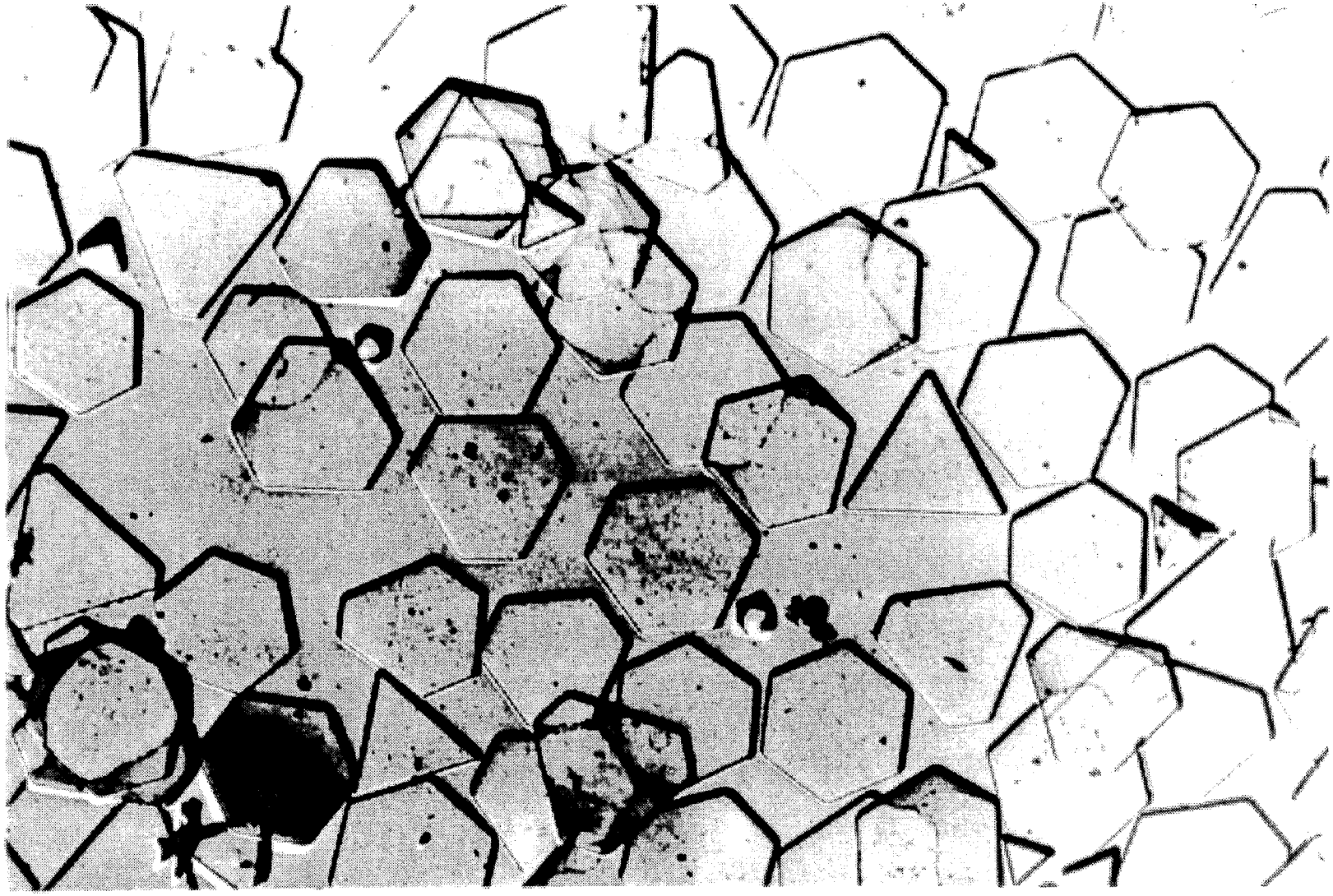
FIG. 5 is an electron micrograph of the emulsion obtained in Example 5 according to the invention at a 11,500× magnification.

The tabular silver halide grains according to the invention can be silver bromide or silver bromoiodide grains. In general, they look like regular or irregular hexagons. FIG. 5 is a photomicrograph of emulsions prepared according to the invention. It can be seen that these emulsions are very homodisperse and contain only a small amount of small three dimensional grains Modifying agents can be present during the seed precipitation, either initially in the reactor, or added at the same time with one or more salts, according to the conventional methods. These modifying agents can be metal compounds such as copper, thallium, bismuth, cadmium, zinc, middle chalcogens (i.e., sulphur, selenium and tellurium), gold and noble metals of the Group VIII, according to the indications mentioned in U.S. Pat. Nos. 1,195,432, 1,951, 933, 2,448, 060, 2,628,167, 2,950,972, 3,488,709, 3,737,313, 3,772,031, 4,269,927 and in *Research Disclosure*, volume 134, June 1975, publication 13452. *Research Disclosure* and its predecessor *Product Licensing Index* are published by Industrial Opportunities Limited; Homewell, Havant; Hampshire, PO9 1EF, Great Britain.

During the third step (growth), the bromide and the silver salt can be added to the reactor by tubes, the output of which is located at or under the surface, by feeding by gravity or by means of apparatus which allow to regulate the addition rate as well as the pH and/or the pAg of the reactor content, such as disclosed in U.S. Pat. Nos. 3,821,002 and 3,031,304 and by Claes and al in *Photographische Korres pondenz*, volume 102, No. 10, 1967, page 162. In order to obtain a rapid distribution of the reagents in the reactor, especially designed blending devices such as those disclosed in U.S. Pat. Nos. 2,996,287, 3,342,605, 3,415,650, 3,785,777, 4,147,551 and 4,171,224, in the British Pat. No. 2,022,431A, in the German Patent Applications 2,555,364 and 2,556,885 and in *Research Disclosure*, volume 166, February 1978, publication 16662, can be used.

In order to form emulsions according to the invention, a peptizer concentration ranging from 0.2 to about 10% in weight based on the total weight of the constituents of the emulsion in the reactor can be used. It is preferred to maintain the peptizer concentration in the reactor at a value less than about 6% of the total weight, before and during the seed formation and preferably, also during the subsequent ripening and to adjust later, at higher values, the vehicle concentration of the emulsion (the vehicle including the binder and the peptizer) by adding further vehicle amounts, in order to obtain the optimum coating characteristics. The emulsion initially formed can contain 5 to 50 g about (and preferably 10 to 30 g) of peptizer per mole of silver bromide. Subsequently, further vehicle amounts can be added to increase the concentration up to 1000 g per mole of silver bromide.

Advantageously, the vehicle concentration in the finished emulsion is more than 50 g per mole of silver bromide. Once applied and dried in a photographic element, the vehicle represents about 30 to 70% of the weight of the emulsion layer.

Vehicles, both including binders and peptizers, can be chosen among the materials commonly used as vehicles in the silver halide emulsions. The preferred peptizers are the hydrophilic colloids which can be used alone or associated with hydrophobic materials. The suitable hydrophilic vehicles include materials such as proteins, protein derivatives, cellulose derivatives, for example, cellulose esters, gelatin such as alkali-treated gelatin (bone or skin gelatin) or acid-treated gelatin (pigskin gelatin), gelatin derivatives such as acetylated or phthalated gelatin. These materials as well as other vehicles are disclosed in *Research Disclosure*, volume 176, December 1978, publication 17643, section IX.

The vehicles can be hardened such as disclosed in paragraph X. The tabular grain emulsions can be mixed with conventional emulsions, such as disclosed in paragraph I.

The tabular grains can be chemically sensitized, such as disclosed in paragraph III and/or spectrally sensitized or desensitized such as disclosed in paragraph IV. The photographic elements can contain brighteners, anti-foggants, stabilizers, absorbing or diffusing agents, coating aids, plasticizers, lubricants and matting agents, such as disclosed in paragraphs V, VI, VIII, XI, XII and XVI. Methods for incorporating addenda, coating and drying, such as those disclosed in paragraphs XIV and XV, can be used. Conventional photographic supports such as those disclosed in paragraph XVII can be used. The resulting photographic elements can be used for black and white photography or for color photography, and they form silver images and/or dye images by selective destruction, formation or physical removal of dyes, such as disclosed in paragraph VII. The preferred color photographic elements are those which form dye images by using color developing agents and dye forming couplers. These photographic elements can be conventionally exposed, such as disclosed in paragraph XVIII, and then processed such as disclosed in paragraph XIX.

The following examples illustrate the invention.

EXAMPLES 1 TO 6 AND COMPARATIVE EXAMPLES A TO D.

These examples show the influence of the different parameters claimed in the first embodiment of the invention. The external static nucleator of FIG. 1 or the one of FIG. 2 is used (see table).

The nucleator is coupled to a 20 l kettle containing the receiving medium comprised of 6 liters of a gelatin solution at 30 g/l containing lg/l of sodium bromide, having a pH of 5.5, a VAg of +30 mV, and a temperature of 70° C., stirred at 4500 rpm.

A 0.5 % gelatin solution containing 0,2 mole/l of potassium bromide, at a flowrate of 108 ml/mn, and a solution containing 0.1 mole/l of silver nitrate at a flowrate of 100 ml/mn, are fed into the nucleator, both solutions having a pH of 5.5 and a temperature of 35° C., during 90s. The mean VAg calculated at the output of the nucleator is −38 mV.

The solution obtained in the kettle is allowed to wait in order to carry out the ripening during 20 to 30 mn, at a temperature of 70° C. and a pH of 5.5 and a stirring of 4500 rpm, at a VAg of 23 mV.

The seeds are then allowed to grow by incorporating 1.5M potassium bromide and 1.5M silver nitrate solutions into the kettle, at 70° C. and a stirring of 4500 rpm, with increasing flowrates. The initial bromide flowrate is 8.3 ml/mn, and is increased according to a law of the type: flowrate=$A+Bt^{\alpha}$ (A=8.3, B=0.439, $\alpha$=1.37) up to 108.9 ml/mn. The initial silver salt flowrate is 8.3 ml/mn and is increased according to a law of the type: flowrate=$A+Bt^{\alpha}$ (A=8.3, B=0.387, $\alpha$=1.4) up to 106.8 ml/mn.

The growth duration is 52 mn.

The data are collected in Table I below. "COV" is the coefficient of variation of the diameter, ECD is the mean circular diameter in μm, and % T is the percentage of tabular grains with respect to the total number of grains. This percentage is more representative of the tabular grain amount obtained than the projected area generally used. Indeed, the non-tabular grain amount as well as the average size of these grains being low, it results that the area projected by the tabular grains is always very significant (>90%) and is not representative of the precipitation quality determined according to the objectives of the present invention.

It can be seen that comparative examples A and B provide a good COV (equal or less than 15%), but very few tabular grains, whereas comparative examples C and D provide a higher number of tabular grains, but a poor COV.

Examples 1 to 6 according to the invention both provide a tabular grain percentage of more than 60% and a COV less than 15%.

FIG. 5 is an electron photomicrograph at 11 500×magnification of the emulsion of Example 5.

We claim:

1. A method for preparing a photographic emulsion containing gelatin and tabular silver halide grains having a number of tabular silver halide grains with respect to the total number of silver halide grains more than 60% and a coefficient of variation of the diameter less than 15% characterized in that:

(a) twinned silver halide seeds are precipitated from halide and silver nitrate solutions, fed into a precipitation medium, under laminar flow conditions determined by a Reynolds number less than 2100, the silver nitrate solution having a concentration ranging from 0.04 to 0.3M, and the seeds being received in a receiving medium;

(b) the seeds are ripened by stopping adding the halide and silver nitrate solutions, under strong stirring, during 1 to 90 mn, and at a VAg more than 0 mV;

(c) the seeds are grown by a double jet technique under strong stirring, at a VAg more than +10 mV.

2. A method according to claim 1, wherein the receiving medium in step (a) has a VAg which is more than −10 mV.

TABLE I

| | Nucleation | Ripening | | | Growth | Data | | |
|---|---|---|---|---|---|---|---|---|
| Examples | Nucleator | $Ag^+$ Conc. | VAg | Duration | VAg | % T | ECD | COV |
| Comp. A | Laminar (FIG. 1) | 0.02M | +23 mV | 20 mn | +23 mV | 24 | 1.4 | 14 |
| Ex. 1 | " | 0.1M | " | " | " | 76 | 1.8 | 10 |
| Comp. B | " | 0.5M | " | " | " | <15 | 1.6 | 15 |
| Comp. C | "T"-shaped (FIG. 2) | 0.1M | " | 1 mn | −40 mV | 83 | 3.2 | 69 |
| Comp. D | " | 0.1M | " | 1 mn | 0 | 83 | 1.7 | 35 |
| Ex. 2 | " | 0.1M | " | 1 mn | +30 mV | 62 | 1.1 | 14 |
| Ex. 3 | " | 0.1M | " | 1 mn | +66 mV | 75 | 0.5 | 14 |
| Ex. 4 | Laminar (FIG. 1) | 0.1M | " | 1 mn | +23 mV | 62 | 1.1 | 14 |
| Ex. 5 | " | 0.1M | " | 20 mn | +23 mV | 62 | 1.8 | 8 |
| Ex. 6 | " | 0.1M | " | 30 mn | +23 mV | 67 | 1.8 | 7 |

EXAMPLE 7—Sensitometric data

The emulsion of example 1 and a control AgBr emulsion exhibiting a wider size distribution were optimally spectrally and chemically sensitized.

These emulsions were applied on a triacetate support at 0.807 g $Ag/m^2$. The resulting element samples were exposed during under a step wedge at a light source of 5500° K. The samples were developed during 3 min 15 sec at 38° C. in a C-41 developer.

Figure 6:
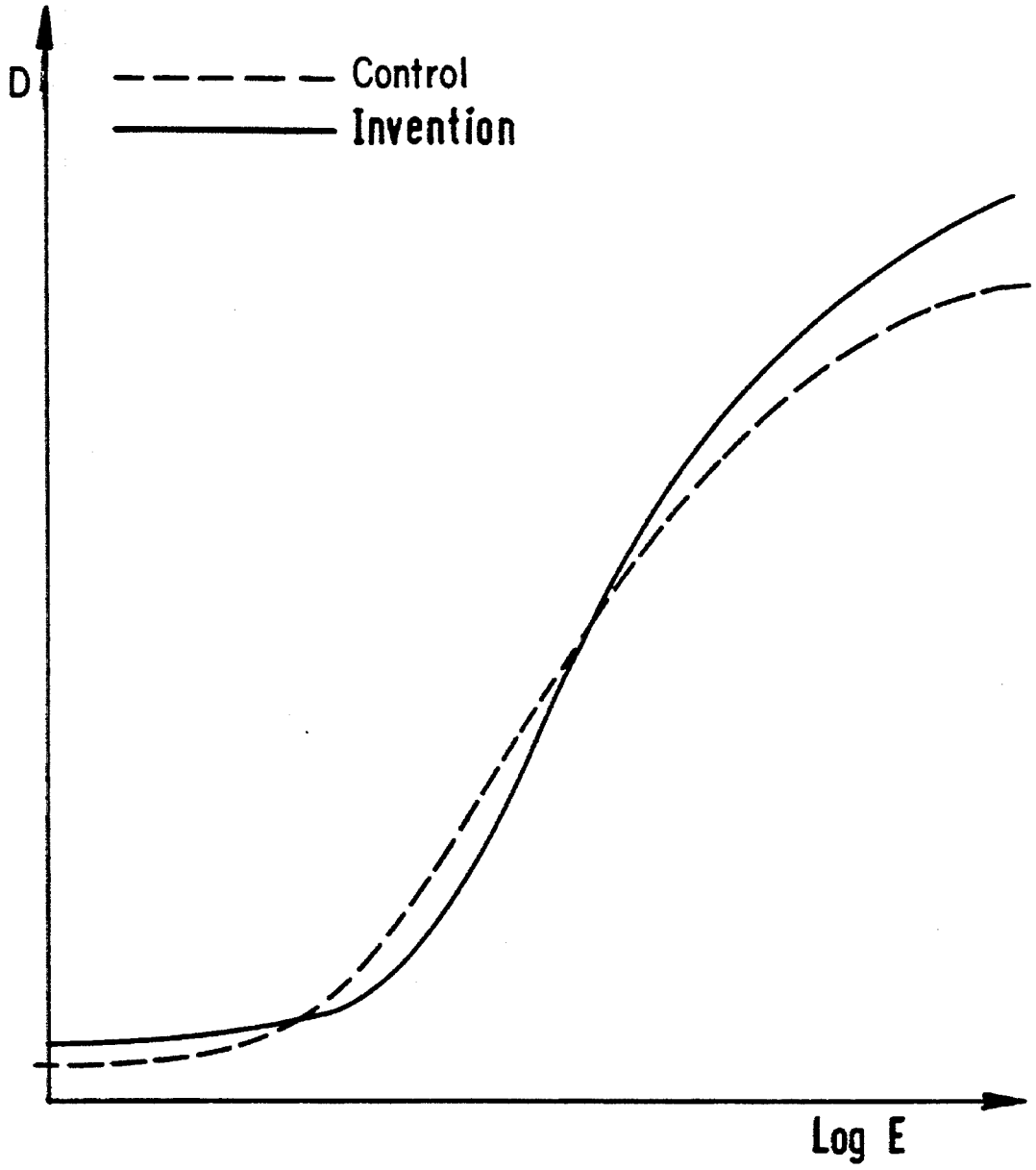
FIG. 6 is the sensitometric curve obtained with the emulsion of the invention and a control emulsion having a wider size distribution.

The sensitometric curves showed that the contrast according to the emulsion was improved with respect to an emulsion exhibiting a wider size distribution (FIG. 6).

3. A method according to any of claims 1 or 2, wherein the seeds are ripened in step (b) during 20 to 30 minutes.

4. A method according to claim 1, wherein the VAg in step (b) is more than 20 mV.

5. A method according to claim 1, wherein the VAg in step (c) is more than 20 mV.

6. A method according to claim 1, wherein step (a) is carried out in an external static nucleator.

7. A method according to claim 6, wherein the twinned seeds reside in the external static nucleator during 0.5 ms to 20 ms.

* * * * *